US011067951B2

(12) United States Patent
Okanishi

(10) Patent No.: US 11,067,951 B2
(45) Date of Patent: Jul. 20, 2021

(54) IMAGE FORMING APPARATUS FOR EXECUTING CALIBRATION

(71) Applicant: CANON KABUSHIKI KAISHA, Tokyo (JP)

(72) Inventor: Tadashi Okanishi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/890,174

(22) Filed: Jun. 2, 2020

(65) Prior Publication Data

US 2020/0379394 A1 Dec. 3, 2020

(30) Foreign Application Priority Data

Jun. 3, 2019 (JP) ..... JP2019-104026

(51) Int. Cl.
*G03G 21/00* (2006.01)
*G03G 21/20* (2006.01)
*G03G 15/00* (2006.01)

(52) U.S. Cl.
CPC ..... *G03G 21/20* (2013.01); *G03G 15/5058* (2013.01); *G03G 15/55* (2013.01); *G03G 2215/00059* (2013.01); *G03G 2215/00569* (2013.01)

(58) Field of Classification Search
CPC ..... G03G 15/5058; G03G 15/5041; G03G 21/20; G03G 21/203; G03G 2215/00029; G03G 2215/00037; G03G 2215/00042; G03G 2215/00059
USPC ..... 399/43, 44, 49
See application file for complete search history.

(56) References Cited

U.S. PATENT DOCUMENTS 6,418,281 B1 7/2002 Ohki
2002/0141769 A1* 10/2002 Phillips ..... G03G 15/50 399/38
2010/0008681 A1* 1/2010 Nagatsuka ..... G03G 21/203 399/43
2010/0239279 A1* 9/2010 Saitou ..... G03G 15/50 399/44
2013/0342853 A1* 12/2013 Nakashio ..... G03G 15/5041 358/1.1
2014/0064798 A1* 3/2014 Miura ..... G03G 15/011 399/301
2014/0178084 A1* 6/2014 Kuo ..... G03G 15/55 399/38

FOREIGN PATENT DOCUMENTS

JP 04036776 A * 2/1992
JP 2000-0238341 A 9/2000
JP 2002-229278 A 8/2002
(Continued)

*Primary Examiner* — Robert B Beatty
(74) *Attorney, Agent, or Firm* — Venable LLP

(57) ABSTRACT

An image forming apparatus, which is configured to execute calibration for controlling an image forming condition, includes a detection unit configured to detect an environmental state in which the image forming apparatus is installed; a prediction unit configured to predict, based on a plurality of detection results detected by the detection unit in a first period, a change in the environmental state in a second period after the first period; and a setting unit configured to set a timing of executing the calibration in the second period based on the change in the environmental state predicted by the prediction unit.

12 Claims, 9 Drawing Sheets

(56) References Cited

FOREIGN PATENT DOCUMENTS

| | | | | |
|---|---|---|---|---|
| JP | 2006189562 | A | * | 7/2006 |
| JP | 2007193054 | A | * | 8/2007 |
| JP | 2012-173390 | A | | 9/2012 |
| JP | 2013-152495 | A | | 8/2013 |
| JP | 2017-037100 | A | | 2/2017 |

* cited by examiner

IMAGE FORMING APPARATUS FOR EXECUTING CALIBRATION

BACKGROUND OF THE INVENTION

Field of the Invention

The present invention relates to an image forming apparatus, and more particularly, to an image forming apparatus such as a printing apparatus, a copying machine, a laser beam printer, or a facsimile machine.

Description of the Related Art

An image forming apparatus using an electrophotographic system is configured to execute calibration to maintain density at a fixed level or correct color misregistration at the time of printing when an environment in which the image forming apparatus is installed has changed. Specifically, when an indicator indicating a change in environment since previous calibration has changed by a predetermined amount, the image forming apparatus actually forms a patch for calibration on an intermediate transfer member, and measures the color of the formed patch. A method of determining an image forming condition in this manner is proposed (Japanese Patent Application Laid-Open No. 2000-238341). Further, a method of predicting the image forming condition based on the amount of change in environment is also proposed (Japanese Patent Application Laid-Open No. 2017-037100).

However, the following problem occurs when whether to execute calibration is determined based only on the actually measured change amount as in the related-art example. Specifically, determination that takes a subsequent change in environment into consideration cannot be performed, and thus there is a fear in that calibration is executed at an unrequired timing, and downtime consequently occurs. Further, when the image forming condition is predicted based on the amount of change in environment as in another related-art example, downtime can be minimized, but there is a fear in that accuracy of correction deteriorates due to a prediction error compared to actual measurement.

SUMMARY OF THE INVENTION

There is provided an image forming apparatus, which is configured to execute calibration for controlling an image forming condition, the image forming apparatus comprising: a first detection unit configured to detect an environmental state in which the image forming apparatus is installed; a prediction unit configured to predict, based on a plurality of detection results detected by the first detection unit in a first period, a change in the environmental state in a second period after the first period; and a setting unit configured to set a timing of executing the calibration in the second period based on the change in the environmental state predicted by the prediction unit.

Further features of the present invention will become apparent from the following description of exemplary embodiments with reference to the attached drawings.

DESCRIPTION OF THE EMBODIMENTS

Now, description is made in detail of embodiments of the present invention with reference to the drawings.

Embodiment 1

In Embodiment 1, there is proposed a method of determining a timing of executing control (hereinafter referred to as "calibration") for optimizing an imaging forming condition by predicting a change in environment and performing density correction, color misregistration correction, or the like based on the predicted result.

Figure 1:
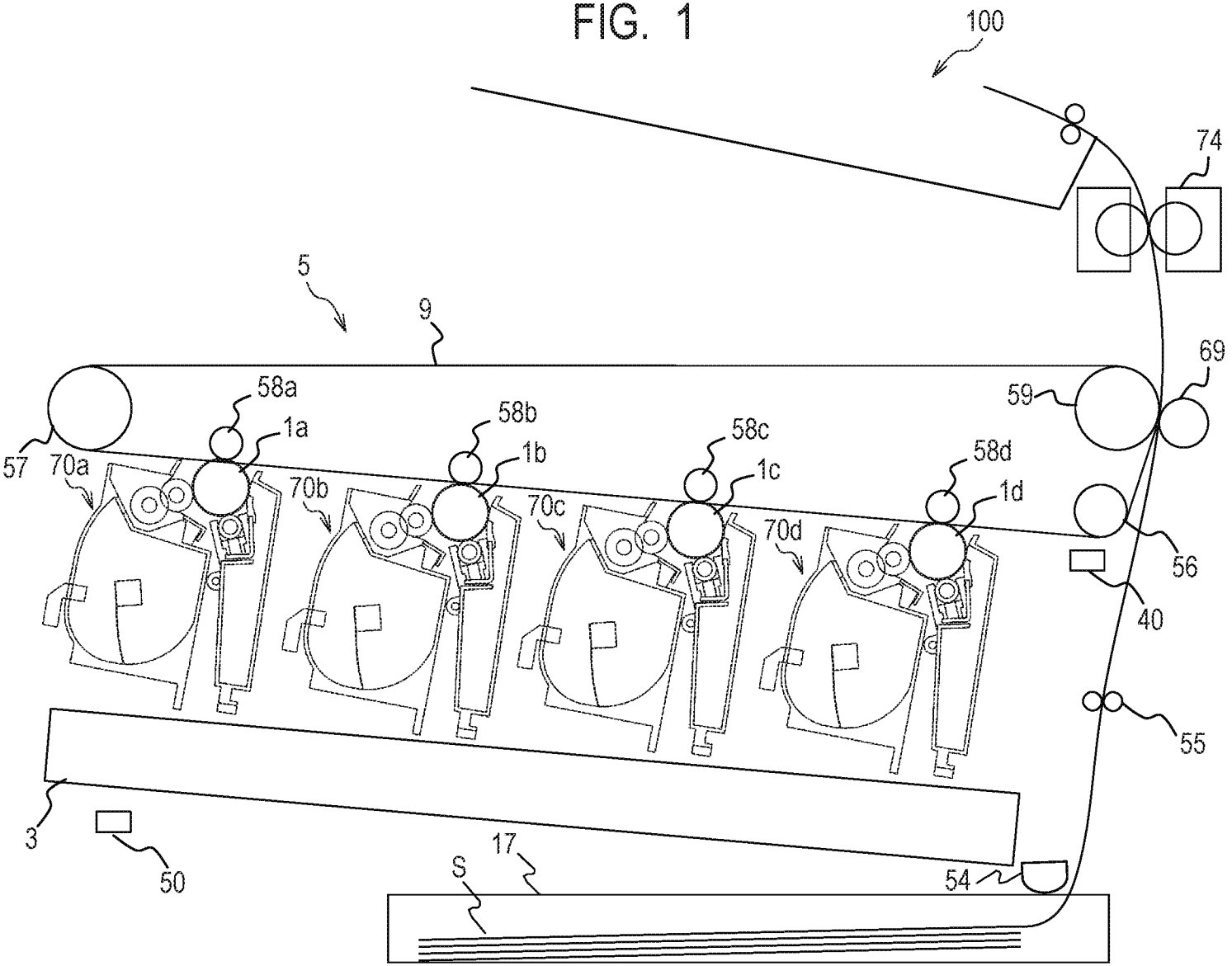
FIG. 1 is a schematic diagram for illustrating a configuration of an image forming apparatus according to Examples 1 and 2.

[Description of Configuration of Image Forming Apparatus of Embodiment 1: FIG. 1]

FIG. 1 is a schematic diagram for illustrating a configuration of an image forming apparatus 100 of Embodiment 1. First, description is made of an overall configuration of the image forming apparatus (hereinafter referred to as "image forming apparatus") 100 using an electrophotographic system with reference to FIG. 1. As illustrated in FIG. 1, four detachable process cartridges 70*a*, 70*b*, 70*c*, and 70*d* (formation units) are mounted to the image forming apparatus 100. The last letters of reference symbols "a", "b", "c", and "d" correspond to yellow (Y), magenta (M), cyan (C), and black (K), respectively, and in the following, the last letters of the reference symbols are omitted except for the case of describing a specific color. The process cartridge 70 incorporates an electrophotographic photosensitive drum (hereinafter referred to as "photosensitive drum") 1. Further, a scanner unit 3 for subjecting the photosensitive drum 1 to selective exposure based on image information and forming a latent image on the photosensitive drum 1 is provided below the process cartridge 70.

A cassette 17 storing sheets S, which are recording media, is mounted to a lower part of the image forming apparatus 100. Further, a transfer roller is provided so that each of the sheets S passes through a secondary transfer roller 69 and a fixing device 74, and then is delivered to the top of the image forming apparatus 100. That is, a feed roller 54 for separately feeding the sheets S in the cassette 17 one by one, and a registration roller pair 55 for synchronizing the latent image formed on the photosensitive drum 1 with the sheets S are provided.

Further, a belt unit 5 for transferring a toner image formed on each photosensitive drum 1 is provided above the process cartridge 70. The belt unit 5 includes a driving roller 56, a driven roller 57, a primary transfer roller 58 arranged at a position opposed to the photosensitive drum 1 of each color, and an opposing roller 59 arranged at a position opposed to the secondary transfer roller 69. A transfer belt 9, which is an intermediate transfer member, is wound around those rollers. The transfer belt 9 rotatably moves in such a manner as to be opposed to and in contact with all the photosensitive drums 1, and a voltage is applied to the primary transfer roller 58, to thereby transfer a toner image from the photosensitive drum 1 onto the transfer belt 9 (primary transfer). Voltages are applied to the secondary transfer roller 69 and the opposing roller 59 arranged in the transfer belt 9, to thereby transfer a color toner image on the transfer belt 9 onto the sheet S (second transfer).

A density sensor 40, which is a second detection unit, is arranged opposite to the transfer belt 9. The image forming apparatus 100 has a function of executing calibration to detect the density of a patch by the density sensor 40 in order to ensure accurate color reproducibility and color stability. The patch refers to a toner image to be detected by the density sensor 40, and is formed on the transfer belt 9. An environmental sensor 50, which is a first detection unit for detecting an environmental state (environmental information) of an environment in which the image forming apparatus is installed, is mounted to the image forming apparatus. The environmental sensor 50 is mounted to a portion at which the environmental sensor 50 is not influenced by heat generated by the image forming apparatus itself and an indicator (e.g., temperature, humidity, and absolute humidity) indicating the environmental state of the environment in which the image forming apparatus is installed can be detected.

Figure 2:
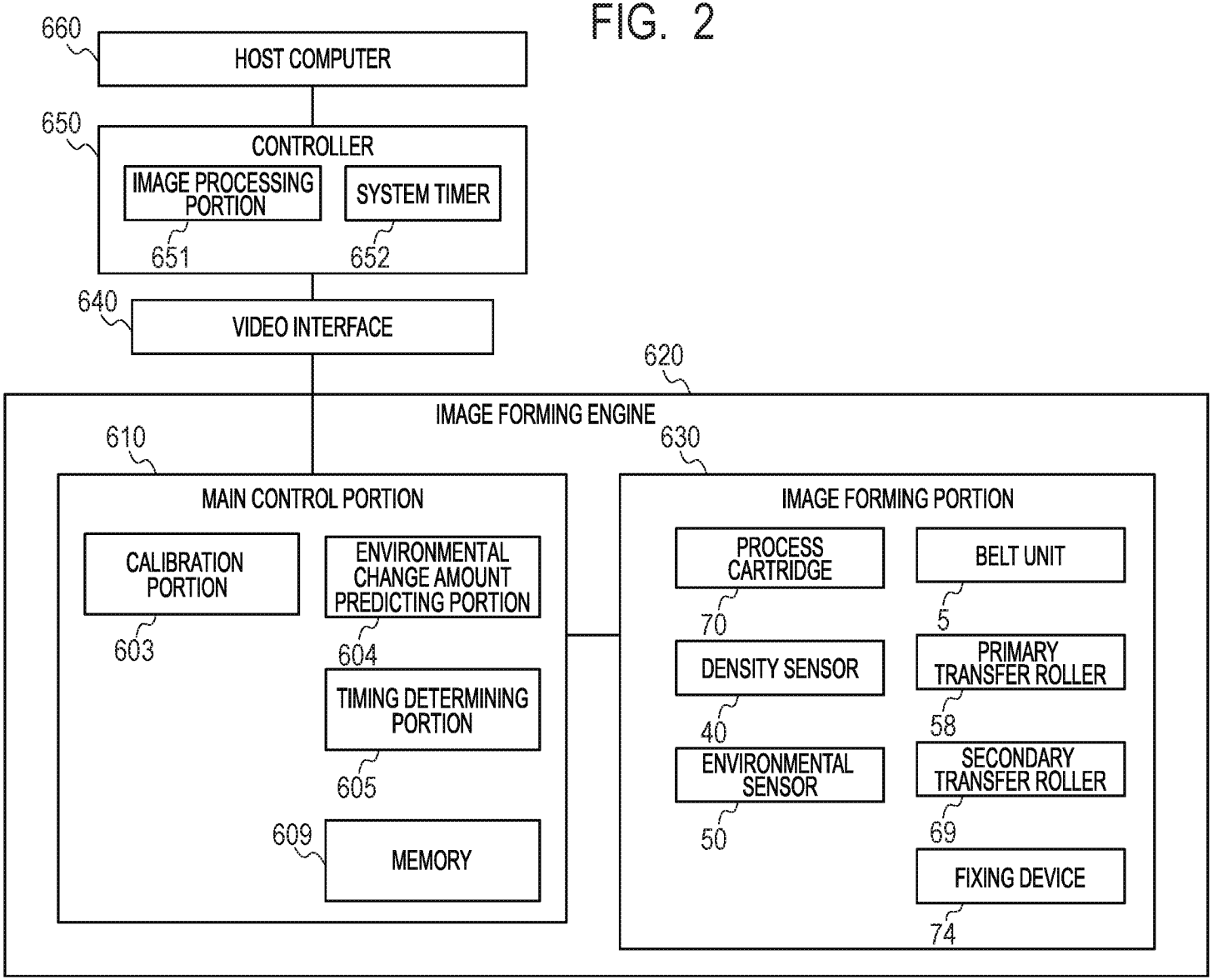
FIG. 2 is a block diagram for illustrating a system configuration of the image forming apparatus according to Example 1.

[Description of System Configuration of Image Forming Apparatus According to Embodiment 1: FIG. 2]

FIG. 2 is a block diagram for illustrating a system configuration of the image forming apparatus according to Embodiment 1. A controller 650 connected to a host computer 660 instructs an image forming engine 620 to form an image via a video interface 640. The controller 650 includes an image processing portion 651 and a system timer 652. The image processing portion 651 is configured to convert image information transmitted from the host computer 660 to image information that can be received by the image forming engine 620. The system timer 652 is a timer configured to measure a time to manage an elapsed period or a date, and can notify the image forming engine 620 of time information via the video interface 640.

The following procedure is performed when an image is actually formed on the sheet S. First, the controller 650 loads image information subjected to image processing by the image processing portion 651 onto an image memory (not shown). The controller 650 outputs the image information on the image memory to the image forming engine 620 via the video interface 640 in synchronization with an image output timing received from the image forming engine 620.

The image forming engine 620 includes a main control portion 610 and an image forming portion 630. The image forming portion 630 includes the process cartridge 70, the belt unit 5, the primary transfer roller 58, the secondary transfer roller 69, the fixing device 74, the density sensor 40, and the environmental sensor 50 described above. The main control portion 610 includes a calibration portion 603, an environmental change amount predicting portion 604, a timing determining portion 605, and a memory 609. The calibration portion 603, which is an execution unit, is configured to execute calibration. The environmental change amount predicting portion 604, which is a prediction unit, is configured to predict an amount of change (hereinafter referred to as "environmental change amount") in indicator indicating an environment in which the image forming apparatus is installed, based on information detected by the environmental sensor 50. The timing determining portion 605, which is a setting unit, is configured to determine (set) a calibration execution timing based on a result predicted by the environmental change amount predicting portion 604. Those series of control procedures are executed by using a CPU or an ASIC, for example. The memory 609, which is a storage unit, accumulates a plurality of pieces of information detected by the environmental sensor 50.

Figure 3A:
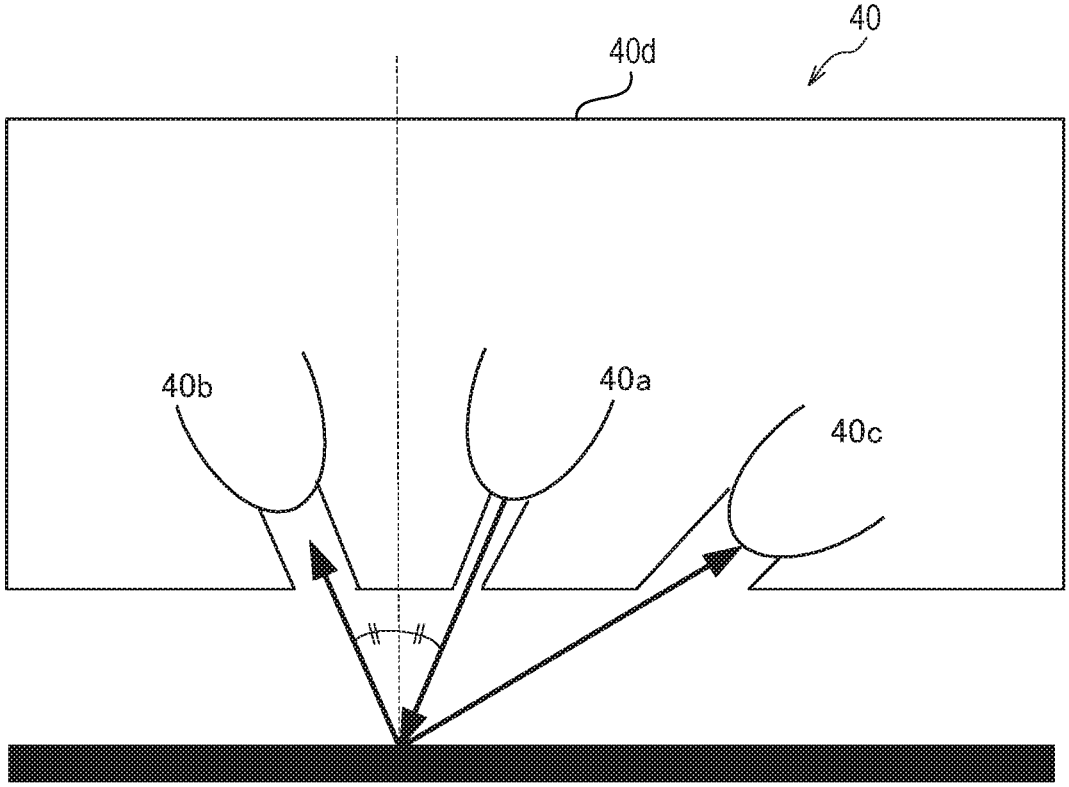
FIG. 3A is a schematic diagram of a density sensor 40 in Examples 1 and 2.

[Description of Density Sensor in Embodiment 1: FIG. 3A]

FIG. 3A is a schematic diagram of the density sensor 40 in Embodiment 1. In the image forming apparatus, the density sensor 40 is arranged opposite to the transfer belt 9, and has a function of detecting the density of a patch for calibration in order to ensure accurate color reproducibility and color stability. Specifically, as illustrated in FIG. 3A, the density sensor 40 includes a light emitting element 40*a* and light receiving elements 40*b* and 40*c*. The light receiving element 40*b* is arranged in such a manner that a light receiving angle and an irradiation angle are the same, and is configured to receive a specular reflection component and a diffused reflection component of reflected light. The light receiving element 40*c* is arranged in such a manner that the light receiving angle and the irradiation angle are different from each other, and is configured to receive only the diffusely reflected component of reflected light. The density sensor 40 includes a holder 40*d*, and the holder 40*d* stores the light emitting element 40*a* and the light receiving elements 40*b* and 40*c*. The image forming apparatus can execute arithmetic processing based on a result of detection of light reflected by the transfer belt 9 itself or light reflected by the toner image on the transfer belt 9, which are received by the two light receiving elements 40*b* and 40*c*, to thereby calculate the density of the transfer belt 9 or the toner image.

In actuality, the color of the toner image changes due to, for example, a change in environment in which the image forming apparatus is used, a use history of various kinds of consumables or the like included in the image forming apparatus, or a change in state of a main body of the image forming apparatus accompanying operation of the image forming apparatus. Thus, the image forming apparatus executes calibration for density correction to set the image forming condition (image creating condition) to an appropriate value at a predetermined timing so as to constantly stabilize the color.

[Description of Environmental Sensor and Threshold Value for Determining Environmental Change in Embodiment 1]

In Embodiment 1, information (result of detection by environmental sensor 50) obtained from the environmental sensor 50 is an absolute humidity, for example. The absolute humidity changes due to a change in environment with respect to an absolute humidity obtained when previous calibration has been executed serving as a reference. Further, a change amount at a time when the absolute humidity has changed such that calibration is required to be executed again because of occurrence of large image variation due to the change in environment is hereinafter referred to as "environmental change threshold value". Specifically, when the environmental change amount with respect to the absolute humidity serving as a reference becomes equal to or larger than the environmental change threshold value as a result of detection by the environmental sensor 50, calibration is executed. For example, the environmental change threshold value (predetermined change amount) is set as 5 g/m$^3$ for the absolute humidity. The environmental sensor 50 of the image forming apparatus monitors the absolute humidity. The image forming apparatus executes calibration when the absolute humidity detected by the environmental sensor 50 has changed by the environmental change threshold value (5 g/m$^3$ or more) (predetermined change amount or more) or more with respect to the previous (reference) absolute humidity.

Figure 3B:
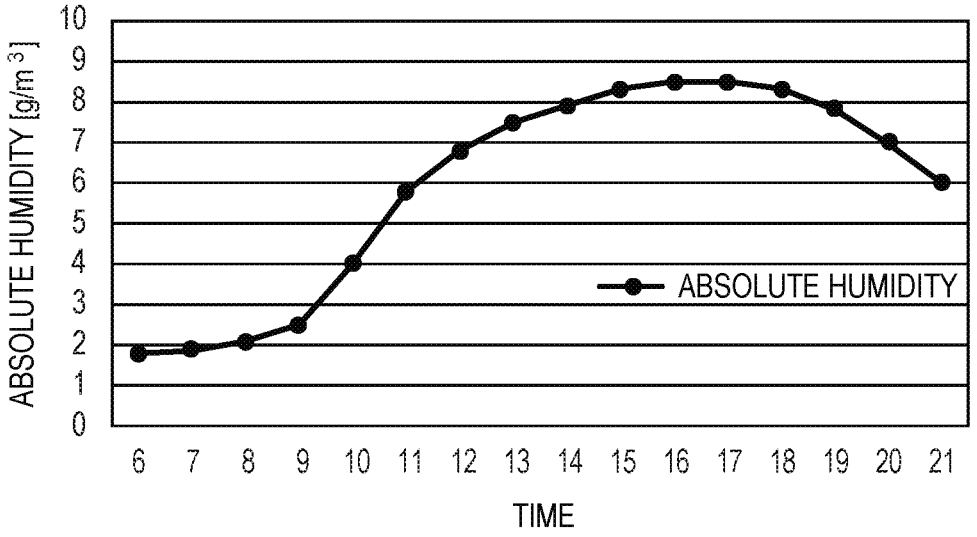
FIG. 3B is a graph for showing results of predicting an absolute humidity.

[Description of Environmental Change Amount Predicting Portion in Embodiment 1: FIG. 3B]

FIG. 3B is a graph for showing results of predicting an environmental change amount in one day (second period) at an office (hereinafter referred to as "Company Z") in which the image forming apparatus is installed, which is obtained by the environmental change amount predicting portion 604. In FIG. 3B, the horizontal axis represents time, and the vertical axis represents the absolute humidity (g/m$^3$). An example of the environment is a situation in which a humidifier has increased the humidity in winter, in which a heater is used.

Regarding the unit for predicting a specific environmental change amount, an absolute humidity over the last three weeks, which is a first period, is averaged for prediction every hour (every predetermined period). Thus, the main control portion 610 stores a result detected by the environmental sensor 50 every hour, for example, into the memory 609. The memory 609 accumulates a plurality of pieces of information (first information) for the last three weeks, which are detected by the environmental sensor 50, for example. The environmental change amount predicting portion 604 reads out those pieces of information for the last three weeks, which are stored in the memory 609, averages results of detection by the environmental sensor 50 every hour, for example, and predicts an environmental change amount in one day, which is a second period subsequent to the last three weeks. For example, the environmental change amount predicting portion 604 averages an absolute humidity at 9 o'clock for the three weeks, and predicts the absolute humidity at 9 o'clock. Next, the environmental change amount predicting portion 604 averages an absolute humidity at 10 o'clock for the three weeks, and predicts the absolute humidity at 10 o'clock. In this manner, the environmental change amount predicting portion 604 predicts the absolute humidity every hour, to thereby predict the change in absolute humidity in one day and obtain a prediction result as shown in FIG. 3B.

It is easily assumed that the time band granularity is changed or the averaging period is changed in order to improve the accuracy of predicting the environmental change amount. Further, it can be assumed that the accuracy is improved greatly by excluding data obtained at a holiday of the office from averaging processing. Further, when working hours of Z company are from 9 o'clock to 17 o'clock, for example, and the power supply of the image forming apparatus is turned on only during the working hours, the environmental change on a time band other than the working hours may not be obtained in actuality. Thus, it is possible to predict the environmental change only during the working hours. In the case of Company Z shown in FIG. 3B, the environmental change amount predicting portion 604 predicts such an environmental change in which the absolute humidity increases at 9 o'clock being a working start time.

Figure 4:
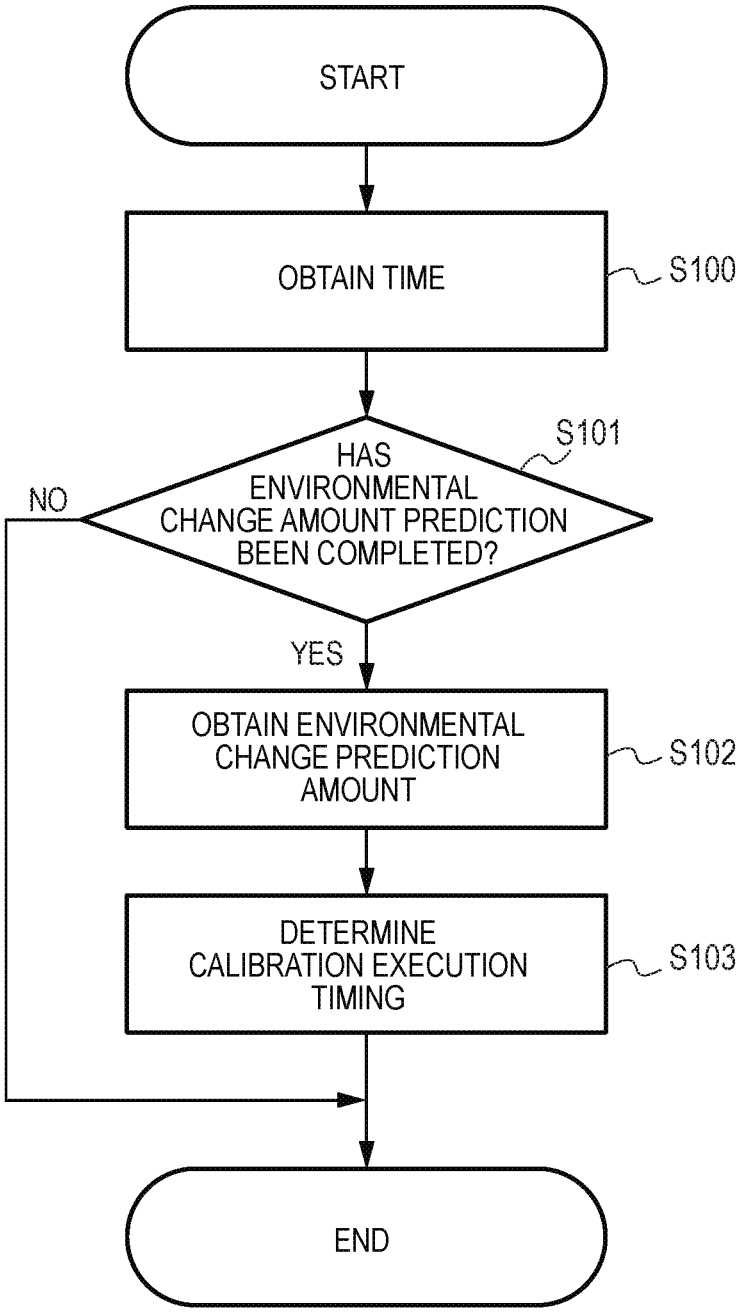
FIG. 4 is a flow chart for illustrating processing of determining a calibration execution timing in Example 1.

[Description of Processing of Determining Calibration Execution Timing in Embodiment 1: FIG. 4]

FIG. 4 is a flow chart for illustrating processing of determining the calibration execution timing due to the environmental change in Embodiment 1. It is assumed that this processing is executed at a timing determined in advance as an example. For example, in Company Z, when the power supply of the image forming apparatus is turned on at 9 o'clock, which is the working start time, the processing of Step S100 and subsequent processing are executed at that time point. In Embodiment 1, the value of the absolute humidity detected by the environmental sensor 50 at 9 o'clock serves as a reference for obtaining the environmental change amount. That is, 9 o'clock is set as a time serving as the reference. In Step S100, the system timer 652 of the controller 650 notifies the main control portion 610 of that time. With this, the main control portion 610 can grasp the time serving as a reference for control.

In Step S101, as described with reference to FIG. 3B, the main control portion 610 uses the environmental change amount predicting portion 604 to determine whether environmental change amount prediction in one day has been completed. In Step S101, when the main control portion 610 has determined that environmental change amount prediction has not been completed, the main control portion 610 ends the processing. In this case, the main control portion 610 cannot determine the calibration execution timing based on environmental change amount prediction, and determines calibration at a related-art timing described later. In Step S101, when the main control portion 610 has determined that environmental change amount prediction has been completed, the main control portion 610 advances the processing to Step S102. In Step S102, the main control portion 610 obtains a prediction value (hereinafter referred to as "environmental change prediction amount") of the predicted environmental change amount. In Step S103, the main control portion 610 determines the calibration execution timing by a method described with reference to FIG. 5 described below based on the environmental change prediction amount obtained in Step S102, and ends the processing.

Figure 5:
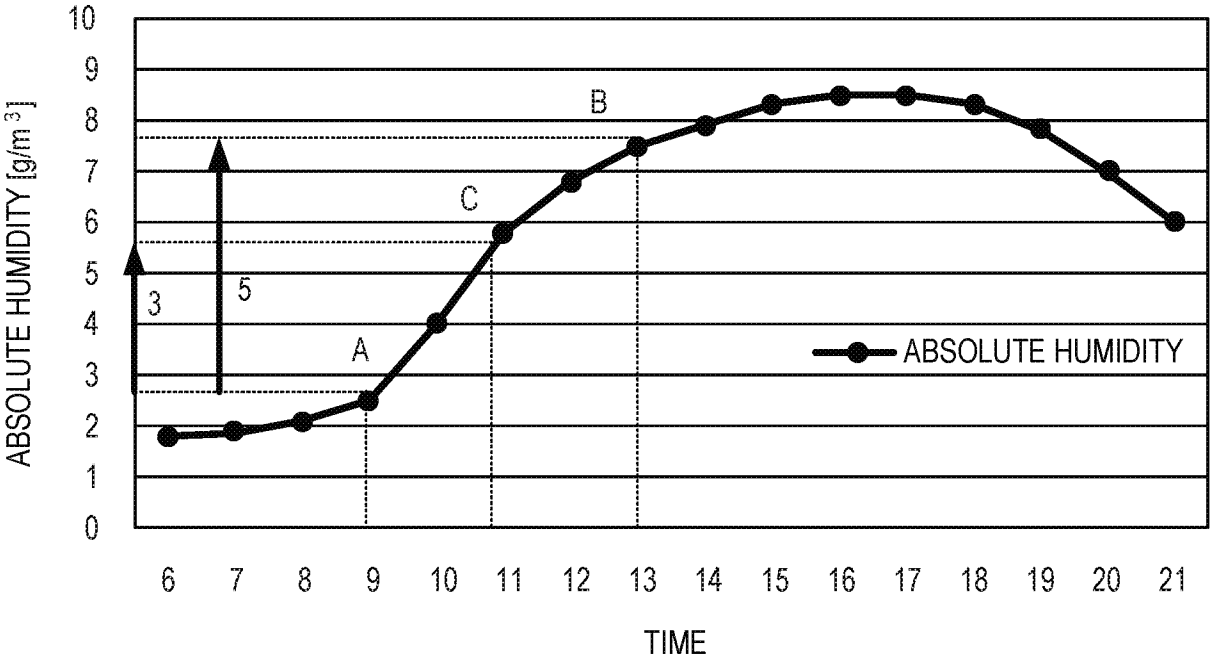
FIG. 5 is a graph for showing the calibration execution timing in Example 1.

[Timing of Executing Calibration in Embodiment 1: FIG. 5]

Now, description is made of a specific calibration execution timing in Embodiment 1 with reference to FIG. 5. The environmental change amount cannot be assumed in a period in which the environmental change amount cannot be predicted by the environmental change amount predicting portion 604 yet, and thus calibration is required to be executed at the time of turning on the power supply at least at a timing at which the image forming apparatus is installed. After that, calibration is executed again when a predetermined environmental change has occurred.

(Period in which Data on Past Absolute Humidity is not Accumulated)

When this situation is applied to Company Z, calibration is executed at the following timing. First, as shown in the point A of FIG. 5, the power supply of the image forming apparatus is turned on and calibration is executed at 9 o'clock in the morning (the absolute humidity is 2.5 g/m$^3$), which is the working start time. After that, the office environment changes with time. As shown in the point B of FIG. 5, calibration is required to be executed again at around 13 o'clock, at which the environmental change threshold value of 5 g/m$^3$ is added to the absolute humidity (2.5 g/m$^3$) at the time of execution of previous calibration to result in an absolute humidity of 7.5 g/m$^3$. That is, calibration is executed at least twice in one day in a period in which the environmental change amount cannot be predicted.

(Period in which Data on Past Absolute Humidity is Accumulated)

It is assumed that about three weeks have elapsed since the installation of the image forming apparatus, and data on the absolute humidity is gradually accumulated in the memory 609. Then, the environmental change amount at the installed place of the image forming apparatus can be predicted. For example, in Company Z, it is understood that the absolute humidity is about 2.5 g/m$^3$ at 9 o'clock, which is the working start time, and the maximum absolute humidity reached through the change between 9 o'clock and 17 o'clock, which is the working end time, is about 8.5 g/m$^3$. Thus, the environmental change amount predicting portion 604 can predict the maximum variation of about 6 (=8.5-2.5) g/m$^3$ in one day for the absolute humidity in the environment of Company Z based on the prediction of FIG. 5.

In this case, it suffices that the calibration execution timing is determined in the following manner in order to prevent occurrence of downtime due to calibration as much as possible. Specifically, as shown in the point C of FIG. 5, calibration is only required to be executed once at around 11 o'clock, which is a time at which about 3 g/m$^3$ being half (½) the variation amount of the maximum change amount (about 6 g/m$^3$) since 9 o'clock in the morning is assumed. The maximum change amount of the absolute humidity in one day is about 6 g/m$^3$, and this value is equal to or larger than about 5 g/m$^3$, which is the environmental change threshold value, and is smaller than twice the value. Specifically, the environmental change amount predicting portion 604 executes prediction as in FIG. 5, and the timing determining portion 605 determines to execute calibration once at 11 o'clock. With this, calibration due to an environmental variation is not required be executed in the period of a season to which prediction by the environmental change amount predicting portion 604 is applicable.

As described above, in Embodiment 1, the timing determining portion 605 can determine an optimal timing in an environment in which the image forming apparatus is installed by adopting the environmental change amount predicting portion 604. Specifically, when the maximum environmental change amount in one day, which is predicted by the environmental change amount predicting portion 604, is equal to or larger than the environmental change threshold value and smaller than twice the value, the timing determining portion 605 executes calibration at a timing of occurrence of change by half the predicted maximum environmental change amount. With this, it is possible to minimize downtime while at the same time providing stable image quality. Calibration is not limited to density control, and it is easily considered that calibration may also be applied to color misregistration adjustment. Further, the environmental change is also not limited to the absolute humidity, and it is easily considered that the environmental change may also be applied to a temperature and a humidity.

As described above, according to Embodiment 1, it is possible to minimize downtime while at the same time providing stable image quality.

Embodiment 2

In Embodiment 2, there is proposed a method of determining the calibration timing by using prediction of usage by a user in addition to prediction of the environmental change amount. In Embodiment 2, details overlapping with those of Embodiment 1 are omitted, and the same reference symbol is assigned to the same configuration or unit for description.

Figure 6:
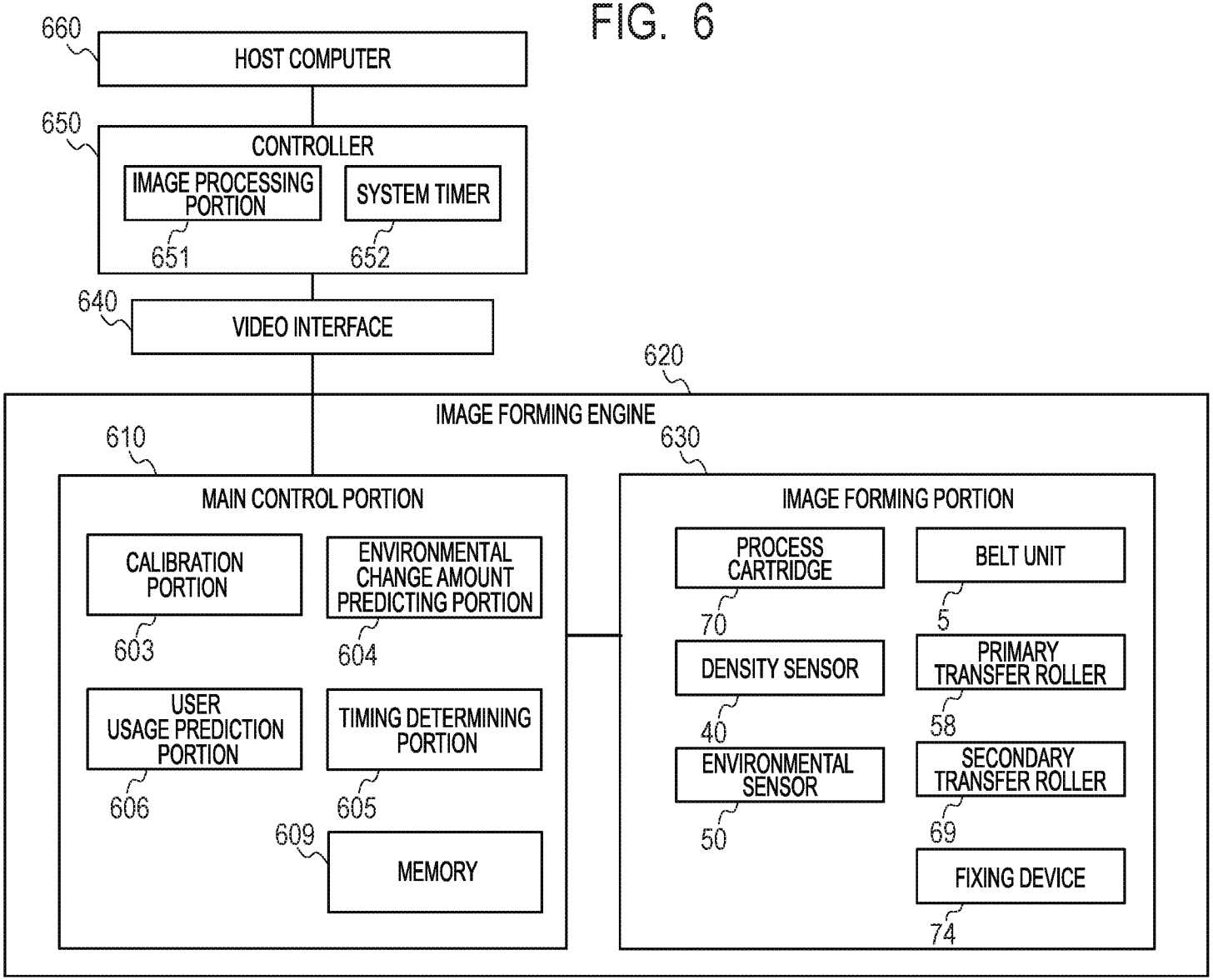
FIG. 6 is a block diagram for illustrating a system configuration of an image forming apparatus according to Example 2.

[Description of System Configuration of Image Forming Apparatus in Embodiment 2: FIG. 6]

FIG. 6 is a block diagram for illustrating a system configuration of an image forming apparatus according to Embodiment 2. A difference from FIG. 2 described in Embodiment 1 resides in that the main control portion 610 further includes a user usage prediction portion 606 as a prediction unit. The user usage prediction portion 606 is configured to predict a frequency at which the user uses the image forming apparatus for printing.

Figure 7:
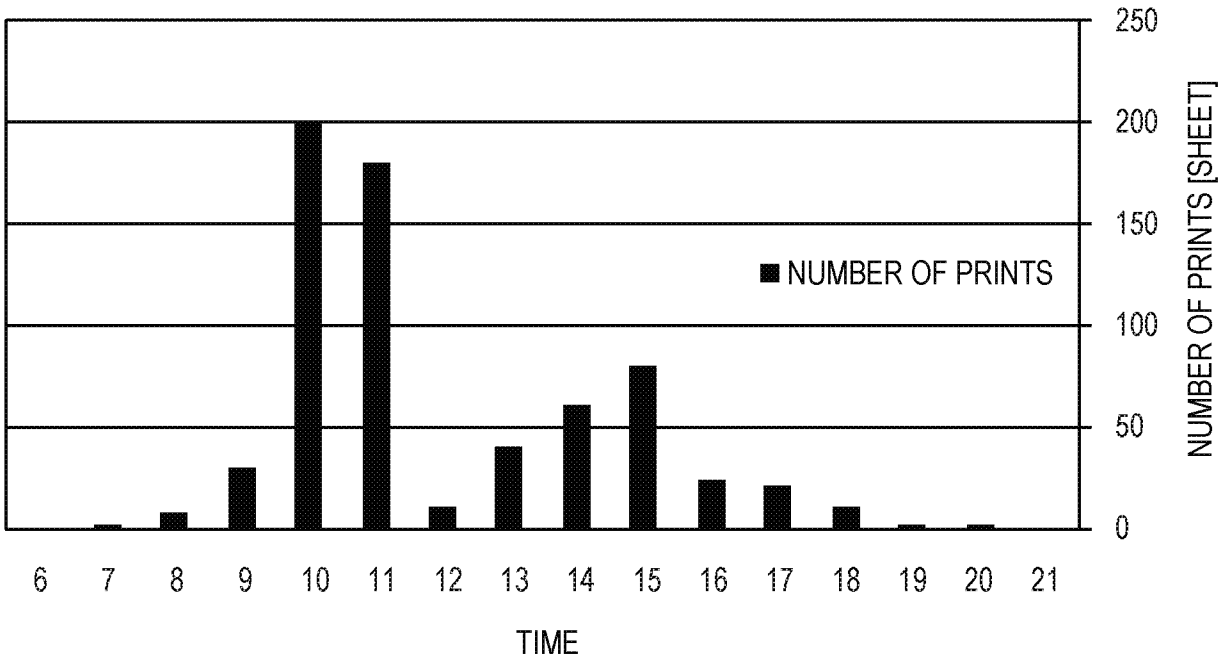
FIG. 7 is a graph for showing results of predicting the number of prints in Example 2.

[Description of User Use Prediction Portion in Embodiment 2: FIG. 7]

FIG. 7 shows a result of predicting the usage frequency of the user in one day, which is obtained by the user usage prediction portion 606 in Company Z similar to that of Embodiment 1, in which the image forming apparatus is installed. In FIG. 7, the horizontal axis represents time, and the vertical axis represents the number of prints (sheets). In Company Z, it is predicted that the number of prints increases between 10 o'clock and 11 o'clock and between 11 o'clock and 12 o'clock, and decreases between 12 o'clock and 13 o'clock.

Similarly to the prediction of the environmental change amount described with reference to FIG. 3B, a unit configured to predict specific user usage executes processing of averaging, every hour, the number of prints over the past three weeks for that time band. Thus, the main control portion 610 stores the number of prints, which are measured every hour, for example, into the memory 609. The memory 609 accumulates the number of prints (second information) for the last three weeks, for example. The user usage prediction portion 606 reads out information for the three weeks, which is stored in the memory 609, averages the number of prints every hour, for example, and predicts a change in number of prints in one day. For example, the user usage prediction portion 606 averages the number of prints between 9 o'clock and 10 o'clock for the three weeks, and predicts the number of prints at between 9 o'clock and 10 o'clock. Next, the user usage prediction portion 606 averages the number of prints between 10 o'clock and 11 o'clock for the three weeks, and predicts the number of prints between 10 o'clock and 11 o'clock. In this manner, the user usage prediction portion 606 predicts the number of prints every hour, to thereby predict a change in number of prints in one day and obtain prediction results (hereinafter referred to as "user usage prediction") as shown in FIG. 7.

It is easily assumed that the time band granularity is changed or the averaging period is changed in order to improve the accuracy of prediction. Further, it can be assumed that the accuracy is improved greatly by excluding data obtained at a holiday of the office from averaging processing. Further, when the working hours of Company Z are from 9 o'clock to 17 o'clock, and the power supply of the image forming apparatus is turned on only during the working hours, user usage prediction on a time band other than the working hours may not be performed in actuality. Thus, it is also possible to perform user usage prediction only during the working hours. The number of prints is used for user usage prediction, but it is easily assumed that a similar effect can be expected also by adopting the operation time (usage time) of the image forming apparatus.

Figure 8:
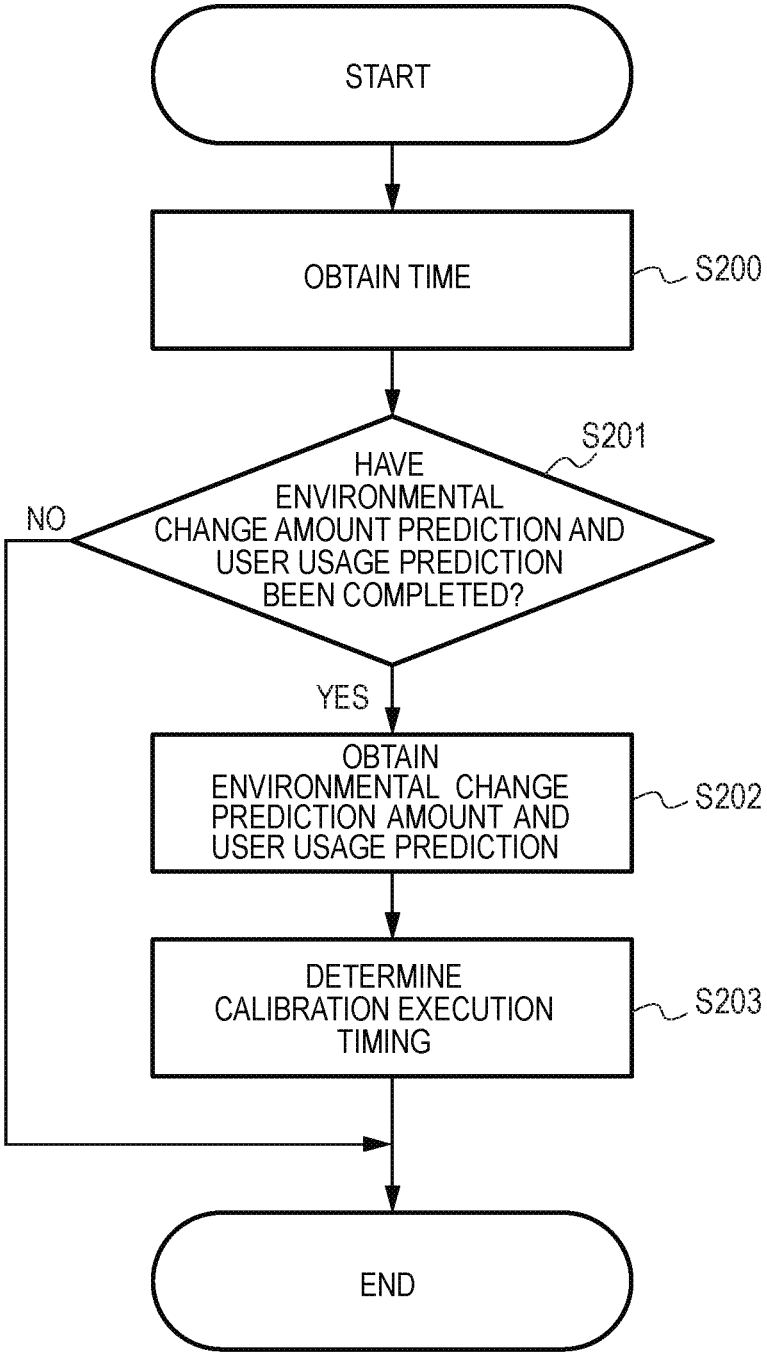
FIG. 8 is a flow chart for illustrating processing of determining the calibration execution timing in Example 2.

[Description of Processing of Determining Calibration Execution Timing in Embodiment 2: FIG. 8]

FIG. 8 is a flow chart for illustrating the processing of determining the calibration execution timing in Embodiment 2. It is assumed that this processing is executed at a timing determined in advance as an example. For example, in Company Z, when the power supply of the image forming apparatus is turned on at 9 o'clock, which is the working start time, this processing is executed at that time point.

Step S200 and Step S203 are similar to the processing of Step S100 and Step S103 of FIG. 4 in Embodiment 1, respectively, and description thereof is omitted here. In Step S201, the main control portion 610 determines whether both of environmental change amount prediction in one day by the environmental change amount predicting portion 604 described with reference to FIG. 3B, and user usage prediction in one day by the user usage prediction portion 606 described with reference to FIG. 7 have been completed. In Step S201, when the main control portion 610 has determined that two predictions have not been completed, the main control portion 610 cannot determine the calibration execution timing based on the environmental change amount prediction and the user usage prediction, and thus ends the processing.

In Step S201, when the main control portion 610 has determined that both of environmental change amount prediction and user usage prediction have been completed, the main control portion 610 advances the processing to Step S202. In Step S202, the main control portion 610 obtains the environmental change prediction amount of that day predicted by the environmental change amount predicting portion 604 and the user usage prediction of that day predicted by the user usage prediction portion 606.

Figure 9:
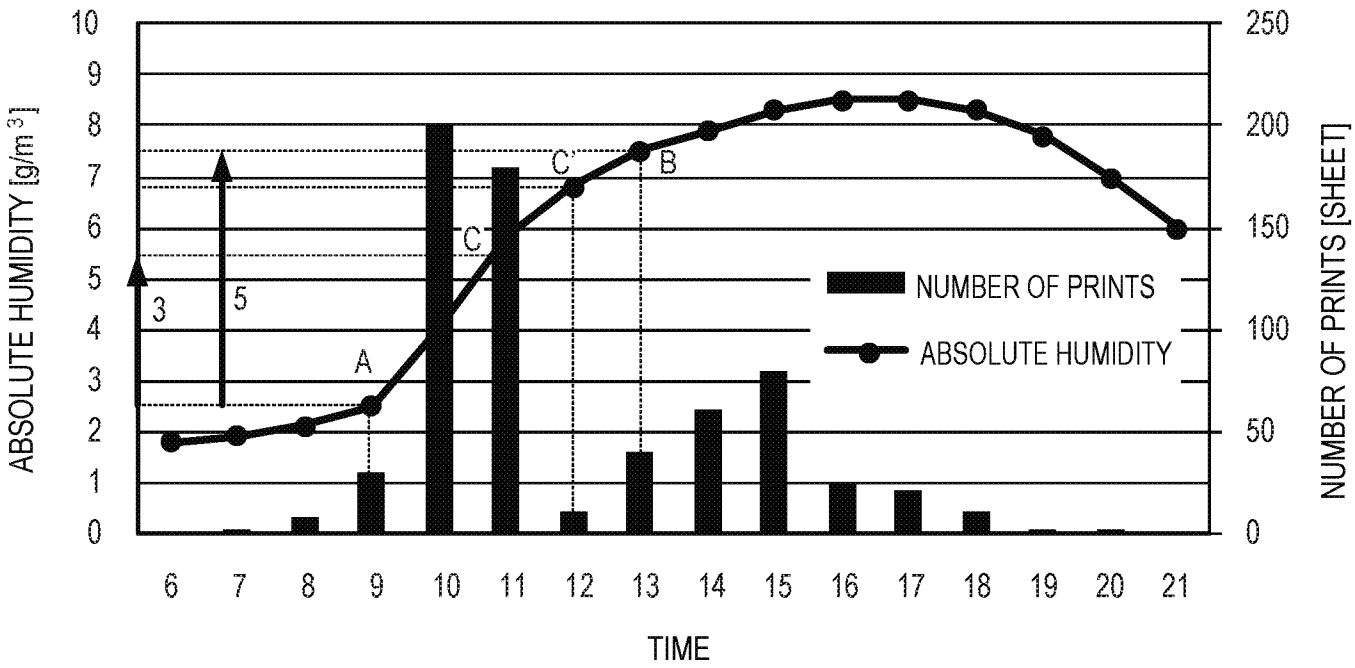
FIG. 9 is a graph for showing the calibration execution timing in Example 2.

(Calibration Execution Timing in Embodiment 2: FIG. 9)

Now, description is made of the processing of determining the specific calibration execution timing in Embodiment 2 with reference to FIG. 9. In FIG. 9, the horizontal axis represents time, the left vertical axis represents the absolute humidity (g/m$^3$), and the right vertical axis represents the number of prints (sheets).

(Period in which Data on Past Environmental Change Amount and User Usage Condition is not Accumulated)

In a period in which the environmental change amount or the user usage condition cannot be predicted yet, as in the related art, for example, calibration is executed at the time of turning on the power supply, and after that, calibration is executed again when a predetermined environmental change has occurred. That is, on the basis of the related-art method, calibration is executed in the point A and the point B of FIG. 9 as described with reference to FIG. 5 in Embodiment 1. Specifically, calibration is executed twice at the point A (at 9 o'clock), which is a timing at which the power supply of the image forming apparatus is turned on, and at the point B (at 13 o'clock), which is a timing at which the amount of change in absolute humidity becomes equal to or larger than the environmental change threshold value.

(Period in which Data on Past Environmental Change Amount and User Usage Condition is Accumulated)

When about three weeks have elapsed and the environmental change amount and user usage condition can be predicted at the installed place of the image forming apparatus, the fact that the environmental change amount in one day is about 6 g/m$^3$, the user usage amount is high between 10 o'clock and 11 o'clock and between 11 o'clock and 12 o'clock, and the user usage amount is conversely low between 12 o'clock and 13 o'clock can now be predicted. That is, as described in Embodiment 1, the timing determining portion 605 determines that execution of calibration at 10:30 shown in the point C of FIG. 9 is optimal based on prediction of the environmental change amount. However, the user usage amount is assumed to be high between 10 o'clock and 11 o'clock and between 11 o'clock and 12 o'clock, and thus when calibration is executed at this timing, the number of users experiencing downtime increases (probability of users experiencing downtime increases).

In view of this, the timing determining portion 605 in Embodiment 2 changes the calibration execution timing within a range (within predetermined range) of the environmental change threshold value of 5 g/m$^3$ with the absolute humidity at the time of previous calibration serving as a starting point. Specifically, the timing determining portion 605 changes the calibration execution timing to a time band having the lowest user usage prediction until 13 o'clock. With this, it is possible to reduce the number of users experiencing downtime. Specifically, as shown in the point C' of FIG. 9, the timing determining portion 605 determines that calibration is executed most preferably at around 12 o'clock in Company Z.

As described above, in Embodiment 2, the calibration execution timing is determined by using the result of prediction by the user usage prediction portion 606 in addition to the result of prediction by the environmental change amount predicting portion 604. With this, it is possible to determine an optimal calibration execution timing in consideration of the environment in which the image forming apparatus is installed and the usage condition of the user, to thereby be able to minimize the downtime while at the same time providing a stable image quality.

As described above, according to Embodiment 2, it is possible to minimize downtime while at the same time providing the stable image quality.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-104026, filed Jun. 3, 2019, which is hereby incorporated by reference herein in its entirety.

What is claimed is:

1. An image forming apparatus, which is configured to execute calibration for controlling an image forming condition, the image forming apparatus comprising:

a detection unit configured to detect an environmental state where the image forming apparatus is located;

a prediction unit configured to predict, based on a plurality of detection results detected by the detection unit in a first period, a change in the environmental state in a second period after the first period, the second period being a period in which the environmental state is not detected by the detection unit; and a setting unit configured to set a timing of executing the calibration in the second period based on the change in the environmental state predicted by the prediction unit.

2. The image forming apparatus according to claim 1, wherein the setting unit is configured to obtain, based on first information indicating the environmental state at a reference time in the second period serving as a reference, a maximum amount of change in the first information based on a prediction result of the environmental state, and set the timing of executing the calibration to a timing at which the first information has changed by ½ of the maximum amount of change with respect to the reference.

3. The image forming apparatus according to claim 2, further comprising a storage unit configured to store the first information for every predetermined period, wherein the prediction unit is configured to predict the change in the environmental state by averaging, for every predetermined period, a plurality pieces of first information for every predetermined period which are stored in the storage unit over the first period.

4. The image forming apparatus according to claim 3, wherein, when the plurality of pieces of first information for every predetermined period over the first period are not stored in the storage unit, the setting unit sets the timing of executing the calibration to a timing at which a power supply of the image forming apparatus is turned on.

5. The image forming apparatus according to claim 4, wherein, when the plurality of pieces of first information for every predetermined period over the first period are not stored in the storage unit, the detection unit detects the environmental state, and the setting unit sets the timing of executing the calibration to a timing at which an amount of change in information detected by the detection unit has become equal to or greater than a predetermined change amount.

6. The image forming apparatus according to claim 3, wherein the first information is an absolute humidity, a humidity, or a temperature.

7. The image forming apparatus according to claim 3, wherein the prediction unit is configured to predict, based on a usage condition of the image forming apparatus, a change in the usage condition in the second period, and wherein the setting unit is configured to change, based on the change in the usage condition, the timing of executing the calibration which is set based on the change in the environmental state.

8. The image forming apparatus according to claim 7, wherein the setting unit is configured to set the timing of executing the calibration to a timing at which a change amount of the first information falls within a predetermined range from ½ of the maximum amount of change to a predetermined value and the usage condition predicted by the prediction unit within the predetermined range becomes lowest.

9. The image forming apparatus according to claim 7, wherein the storage unit is configured to store second information indicating the usage condition for every predetermined period, and wherein the prediction unit is configured to predict the change in the usage condition by averaging, for every predetermined period, a plurality of pieces of second information for every predetermined period which are stored in the storage unit over the first period.

10. The image forming apparatus according to claim 7, wherein the usage condition is a number of prints or a usage time of the image forming apparatus.

11. The image forming apparatus according to claim 1, further comprising:

an intermediate transfer member;

a formation unit configured to form a toner image on the intermediate transfer member;

a second detection unit configured to detect the intermediate transfer member or the toner image; and an execution unit configured to execute the calibration.

12. The image forming apparatus according to claim 11, wherein the execution unit is configured to detect density or color misregistration by the second detection unit.

* * * * *